US010800579B1

(12) United States Patent
Lim

(10) Patent No.: US 10,800,579 B1
(45) Date of Patent: Oct. 13, 2020

(54) TUBE CONTAINER HAVING SHUTOFF FUNCTION ON SHOULDER AND NECK AND METHOD OF MANUFACTURING THE SAME

(71) Applicant: Jong Su Lim, Pocheon-si (KR)

(72) Inventor: Jong Su Lim, Pocheon-si (KR)

( * ) Notice: Subject to any disclaimer, the term of this patent is extended or adjusted under 35 U.S.C. 154(b) by 0 days.

(21) Appl. No.: 16/795,863

(22) Filed: Feb. 20, 2020

(30) Foreign Application Priority Data

May 31, 2019 (KR) ..... 10-2019-0064410

(51) Int. Cl.
*B65D 35/14* (2006.01)
*B65D 35/10* (2006.01)

(52) U.S. Cl.
CPC ..... *B65D 35/14* (2013.01); *B65D 35/10* (2013.01)

(58) Field of Classification Search
CPC ..... B65D 35/14; B65D 35/10
USPC ..... 215/12.2
See application file for complete search history.

(56) References Cited

U.S. PATENT DOCUMENTS 3,081,006 A * 3/1963 Land ..... B65D 47/2018 222/212
3,260,411 A * 7/1966 Dobson ..... B65D 35/12 222/107
3,669,323 A * 6/1972 Harker ..... B65D 35/14 222/490
3,700,513 A * 10/1972 Haberhauer ..... B29C 65/3656 156/69
5,275,311 A * 1/1994 Piarrat ..... B65D 35/14 222/105
5,656,346 A * 8/1997 Hirt ..... B65D 35/08 428/36.91
5,804,270 A * 9/1998 Kawamura ..... B65D 35/10 206/277
5,918,783 A * 7/1999 Kieras ..... B65D 1/0238 222/541.6
6,270,867 B1 * 8/2001 Eckstein ..... B65D 35/10 428/35.7

(Continued)

FOREIGN PATENT DOCUMENTS

JP 2007284127 A 11/2007
JP 2009279832 A 12/2009

(Continued)

*Primary Examiner* — Ernesto A Grano
(74) *Attorney, Agent, or Firm* — Novick, Kim & Lee, PLLC; Jae Youn Kim

(57) ABSTRACT

Provided are a tube container having a shutoff function on a shoulder and a neck and a method of manufacturing the same, in which a head gas barrier layer formed of an aluminum sheet is bonded to inner surfaces of the shoulder and the neck serving as a head to correspond to the inner surfaces according to formation of the head, and thus the shutoff function is provided to prevent chemical changes in even a shoulder and neck portion due to external environmental factors, so that contents filled in the tube container are prevented from decaying or deteriorating, and intrinsic ingredients of the contents are prevented from being lost for a long time. Accordingly, the contents are prevented from decaying or deteriorating due to the external environmental factors, and the intrinsic ingredients of the contents are used for a long time without losing the intrinsic ingredients.

2 Claims, 3 Drawing Sheets

(56) References Cited

U.S. PATENT DOCUMENTS

| | | | | |
|---|---|---|---|---|
| 6,305,577 | B1 * | 10/2001 | Fillmore | B05B 11/0043 222/105 |
| 7,757,884 | B2 * | 7/2010 | Scheifele | B29C 43/18 215/12.1 |
| 9,463,906 | B2 * | 10/2016 | Kerman | B32B 15/085 |
| 9,957,086 | B2 * | 5/2018 | Kerman | B65D 35/10 |
| 2009/0188940 | A1 * | 7/2009 | Razzaghi | B65D 35/14 222/107 |
| 2012/0305121 | A1 * | 12/2012 | Sanchez | B65D 35/14 138/89 |
| 2015/0344191 | A1 * | 12/2015 | Maurice | B29C 45/14008 215/379 |
| 2018/0093401 | A1 * | 4/2018 | Geiger | B29C 45/14598 |
| 2018/0345628 | A1 * | 12/2018 | Limatibul | B65D 35/14 |
| 2019/0112107 | A1 * | 4/2019 | Fern Ndez De Mendiola Quintana | B65D 35/46 |
| 2019/0256240 | A1 * | 8/2019 | Kisielinski | B32B 7/12 |
| 2020/0047952 | A1 * | 2/2020 | Tanaka | B65D 35/245 |

FOREIGN PATENT DOCUMENTS

| | | | |
|---|---|---|---|
| KR | 200364918 | Y1 | 10/2004 |
| KR | 10-0554087 | B1 | 2/2006 |
| KR | 10-1348125 | B1 | 1/2014 |
| KR | 10-2017-0097600 | A | 8/2017 |
| KR | 20-2017-0003720 | U | 10/2017 |

* cited by examiner

TUBE CONTAINER HAVING SHUTOFF FUNCTION ON SHOULDER AND NECK AND METHOD OF MANUFACTURING THE SAME

BACKGROUND OF THE INVENTION

1. Field of the Invention

The present invention relates to a tube container, and more particularly, to a tube container having a shutoff function on a shoulder and a neck and a method of manufacturing the same, in which the shutoff function is provided to prevent chemical changes due to external environmental factors from occurring in even a shoulder and neck portion that serves as a head of the tube container, so that contents filled in the tube container can be prevented from decaying or deteriorating, and intrinsic ingredients of the contents can be prevented from being lost for a long time.

2. Description of the Related Art

In general, tube containers are used for various purposes due to the convenience of manufacture and use.

The tube container, among the various tube containers, used after filled with medicine, cosmetic, toothpaste or the like has a technical configuration for effectively protecting the filled contents from external environments.

In other words, conventional aluminum (Al) sheets are generally used as a gas barrier layer, to block infiltration of external environmental factors such as ultraviolet rays, oxygen, and air so that the contents can be prevented from decaying, deteriorating or the like due to chemical changes caused by the contact of the contents with the external environmental factors, and intrinsic ingredients of the contents can be maintained for a long time, in which the above-described tube container is generally referred to as a laminated tube.

According to the tube container having the gas barrier layer formed of the conventional aluminum sheet, the gas barrier layer is positioned in a middle portion, and resin layers formed of copolymer having excellent adhesion property are provided on inner and outer sides about the gas barrier layer, respectively.

In addition, after a surface layer is formed by bonding a polyethylene film to an outer side of the outer resin layer, and a film layer is bonded to an inner inside of the inner resin layer, both ends overlap each other and a side sealing is performed through ultrasonic or high-frequency fusion. Then, a tube body is manufactured by cutting the target in a desired length.

Then, after forming a head including a shoulder and a neck at one end of the tube body by using a well-known tube head forming device, a sealing work is performed on an outlet of the neck. A cap is fastened to the neck by a well-known scheme.

Then, after required contents are filled through a side opposite to the head, an end sealing is performed, and thus a fabrication of the tube container filled with the contents is completed.

Korean Registered Patent Publication No. 10-0554087, Korean Registered Patent Publication No. 10-1348125, Korean Unexamined Utility Model Publication No. 20-2017-0003720, Korean Unexamined Patent Publication No. 10-2017-0097600, and the like disclose the related art on the conventional tube container including the gas barrier layer formed of the aluminum sheet as described in the above manner (Hereinafter, referred to as 'document of related art').

(Patent Document 1) Korean Registered Patent Publication No. 10-0554087

(Patent Document 2) Korean Registered Patent Publication No. 10-1348125

(Patent Document 3) Korean Unexamined Utility Model Publication No. 20-2017-0003720

(Patent Document 4) Korean Unexamined Patent Publication No. 10-2017-0097600

SUMMARY OF THE INVENTION

However, as described in the Background of the invention, the tube containers according to the documents of related art in addition to the conventional tube container including the gas barrier layer formed of the general aluminum sheet have disadvantages in that the gas barrier layer formed of the aluminum sheet is provided at the tube body, but is not provided at a shoulder as well as a neck that serve as a head.

Accordingly, external environmental factors such as ultraviolet rays, oxygen, and air cannot be prevented from infiltrating through the shoulder or neck that is not provided with the gas barrier layer, and chemical changes occur in the contents due to contact with the external environmental factors, and thus the contents decay, deteriorate or the like, and intrinsic ingredients of the contents are damaged in a short time.

In order to solve the above-mentioned conventional problems, the specific embodiments of the present invention provides a tube container having a shutoff function on a shoulder and a neck and a method of manufacturing the same, in which the shutoff function may be provided to prevent chemical changes from occurring in even a shoulder and neck portion as a head of the tube container due to external environmental factors, so that contents filled in the tube container can be prevented from decaying or deteriorating, and intrinsic ingredients of the contents can be prevented from being lost for a long time.

The specific embodiments of the present invention further provides that the lower end of the head gas barrier layer may be tightly bonded to the tube body.

In order to solve the above technical problems, the specific embodiments of the present invention may include a tube container including a tube body including a gas barrier layer formed of an aluminum sheet, and a shoulder and a neck that serve to a head and are formed at a front end of the tube body, in which a head gas barrier layer formed of an aluminum sheet may be bonded to inner surfaces of the shoulder and the neck as the head in the form corresponding to the inner surfaces according to formation of a head.

An edge of a lower end of the head gas barrier layer may be bonded by a junction formed between an outer surface of the edge and an inner surface of the front end of the tube body according to the formation of the head.

The method according to the present invention includes: manufacturing a tube body including a gas barrier layer formed of an aluminum sheet; cutting the manufactured tube body to have a predetermined length; manufacturing a head gas barrier layer formed of an aluminum sheet to have a shape corresponding to a shoulder and a neck that serve as a head and are formed at a front end of the cut tube body; and forming the shoulder and the neck serving as the head by using a head forming device such that the head gas barrier layer is positioned on an inner surface of the tube body after the manufactured head gas barrier layer is positioned at the front end of the tube body.

According to the present invention, the shutoff function may be provided to prevent chemical changes from occurring in even a shoulder and neck portion as a head of the tube container due to external environmental factors, so that contents filled in the tube container can be prevented from decaying or deteriorating, and intrinsic ingredients of the contents can be prevented from being lost for a long time. Thus, the contents can be prevented from decaying or deteriorating due to the external environmental factors, and the intrinsic ingredients of the contents can be used for a long time without losing the intrinsic ingredients.

In addition, the lower end of the head gas barrier layer may be tightly bonded to the tube body, so that the reliability of the product can be increased.

DETAILED DESCRIPTION OF THE INVENTION

Hereinafter, preferred embodiments of the present invention will be described in detail with reference to the accompanying drawings, and the present invention is not limited to or restricted by the embodiments.

Figure 1:
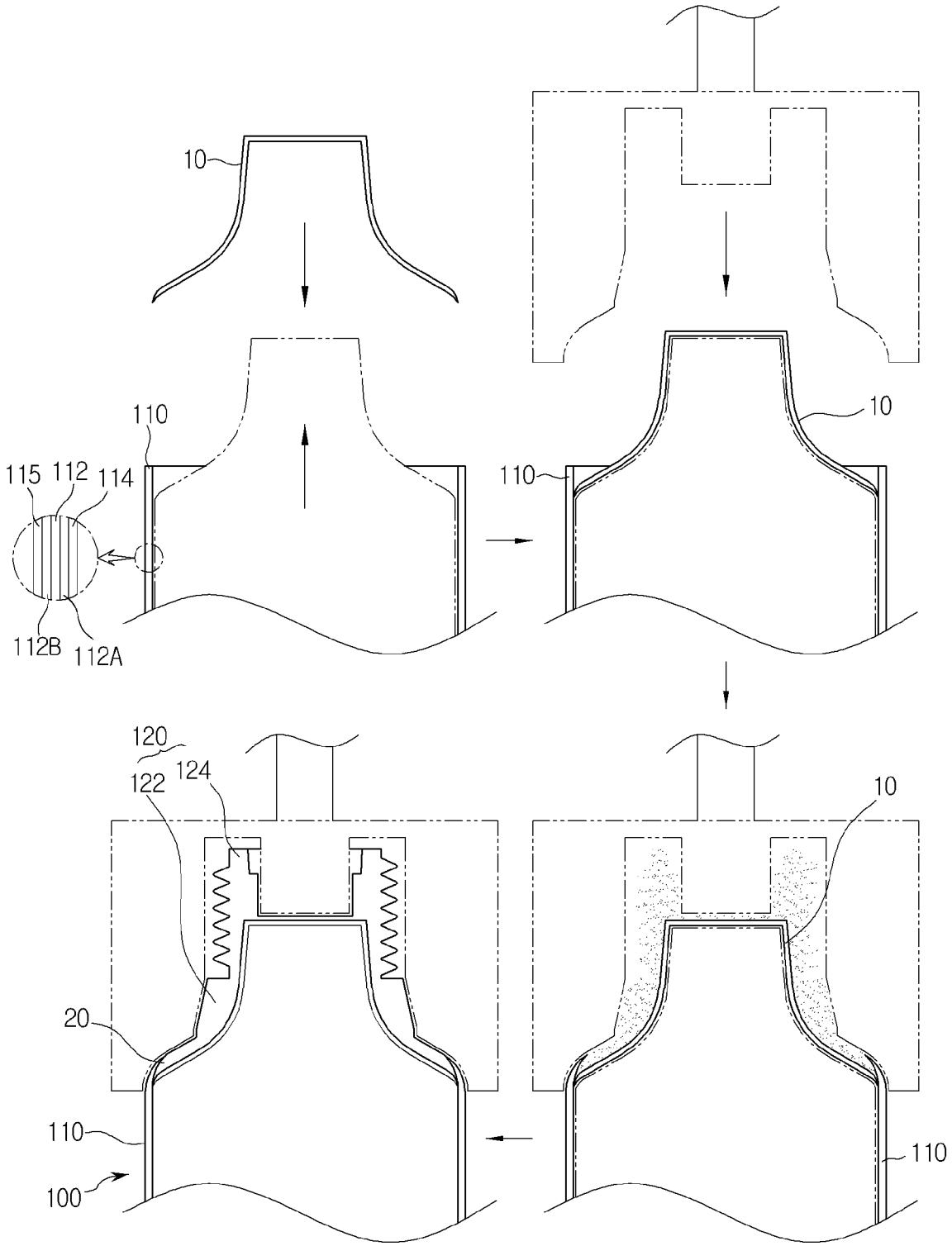
FIG. 1 is a sectional flow chart for illustrating the present invention.
Figure 2:
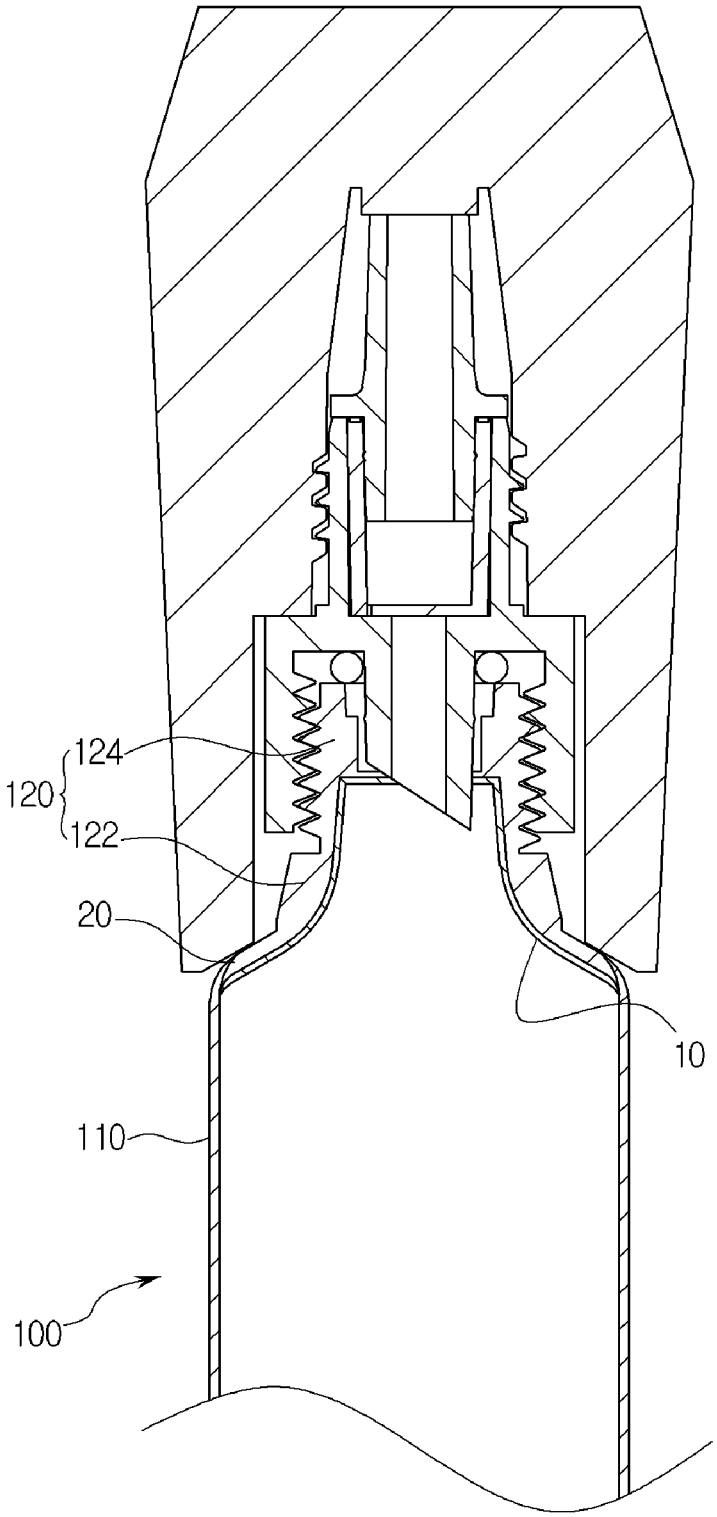
FIG. 2 is a sectional view for illustrating a state of use of the present invention.

FIG. 1 is a sectional flow chart for illustrating the present invention. FIG. 2 is a sectional view for illustrating a state of use of the present invention.

As shown in the drawings, in general, a tube container 100 used after filled with medicine, cosmetic, toothpaste or the like is configured to include a gas barrier layer 112 formed of an aluminum sheet to effectively protect the filled contents from external environments.

In other words, according to the general tube container 100 having the gas barrier layer 112 formed of the aluminum sheet, the gas barrier layer 112 is interposed in a middle, and resin layers 112A and 112B formed of copolymer having excellent adhesion are provided on inner and outer sides about the gas barrier layer.

In addition, after a surface layer 115 is formed by bonding a polyethylene film to an outer side of the outer resin layer 112B, and a film layer 114 is bonded to an inner inside of the inner resin layer 112A, both ends overlap each other and a side sealing is performed through ultrasonic or high frequency fusion. Thus, a cutting by a predetermined length is performed to manufacture a tube body 110.

Then, after forming a head 120 including a shoulder 122 and a neck 124 at one end of the tube body by using a well-known tube head forming device, a lid sealing is performed on an outlet of the neck by a well-known scheme. A cap is fastened to the neck by a well-known scheme.

Then, after required contents are filled through a side opposite to the formed head, an end sealing is performed, and thus a fabrication of the tube container 100 filled with the contents is completed.

However, there are disadvantages in that the contents may decay or deteriorate due to the external environmental factors at the shoulder and neck as a head of the tube container including the gas barrier layer formed of the conventional aluminum sheet, and the inherent ingredients of the contents may be lost.

According to the present invention, the shutoff function is provided to prevent chemical changes from occurring in even a shoulder and neck portion as a head of the tube container due to external environmental factors, so that contents filled in the tube container can be prevented from decaying or deteriorating, and the intrinsic ingredients of the contents can be prevented from being lost for a long time.

The technical configuration, which has a function of blocking the external environmental factors at the shoulder 122 and the neck 124 of the head 120 in the front end of the tube body 110 according to the present invention, includes that the head gas barrier layer 10 formed of the conventional aluminum sheet is bonded to inner side surfaces of the shoulder 122 and the neck 124 of the head 120 in the form corresponding to the inner side surfaces according to the formation of the head 120 in the conventional head forming device.

The head gas barrier layer 10 formed of the aluminum sheet is formed to have a shape of a lamp shade to correspond to the shoulder 122 and the neck 124 constituting the head 120, in which a top surface positioned corresponding to the neck is manufactured to be closed.

In other words, as the head is formed in the head forming device after the head gas barrier layer formed of the aluminum sheet and having the shape corresponding to the shoulder and neck of the head is positioned at the front end of the tube body, the head gas barrier layer naturally is bonded to the inner side surface of the head. At this time, since the head is formed using a PE material or a copolymer that is a general synthetic resin having excellent adhesion, an additional adhesive is not required, and the aluminum sheet, which is the head gas barrier layer, naturally is bonded at the same time of the forming.

Further, a lower edge of the head gas barrier layer 10 is bonded by a junction 20 formed between an outer surface of the edge and an inner surface of the front end of the tube body 110 according to the formation of the head 120.

In other words, when a part of molten resin upon the head forming is introduced while being permeated into a space between the outer surface of the edge of the head gas barrier layer and the inner surface of the front end of the tube body, the contacting portions are tightly bonded to each other.

Accordingly, the tube body and the head gas barrier layer bonded to the inner surface of the head according to the head forming are also bonded to each other with high airtightness.

Further, in the head gas barrier layer, a top surface positioned corresponding to the neck may be perforated, for use, by a punching pin or the like provided in the cap, or may be perforated by using a separate tool.

Therefore, according to the present invention, the gas barrier layer is formed of the aluminum sheet in the tube body of the tube container, and the head gas barrier layer, which has a function of blocking the shoulder and neck portion that is the head from the external environmental factors without an especially complicated technical configuration, so that the contents can be prevented from decaying or deteriorating.

Further, the intrinsic ingredients of the contents can be maintained for a long time without loss.

Figure 3:
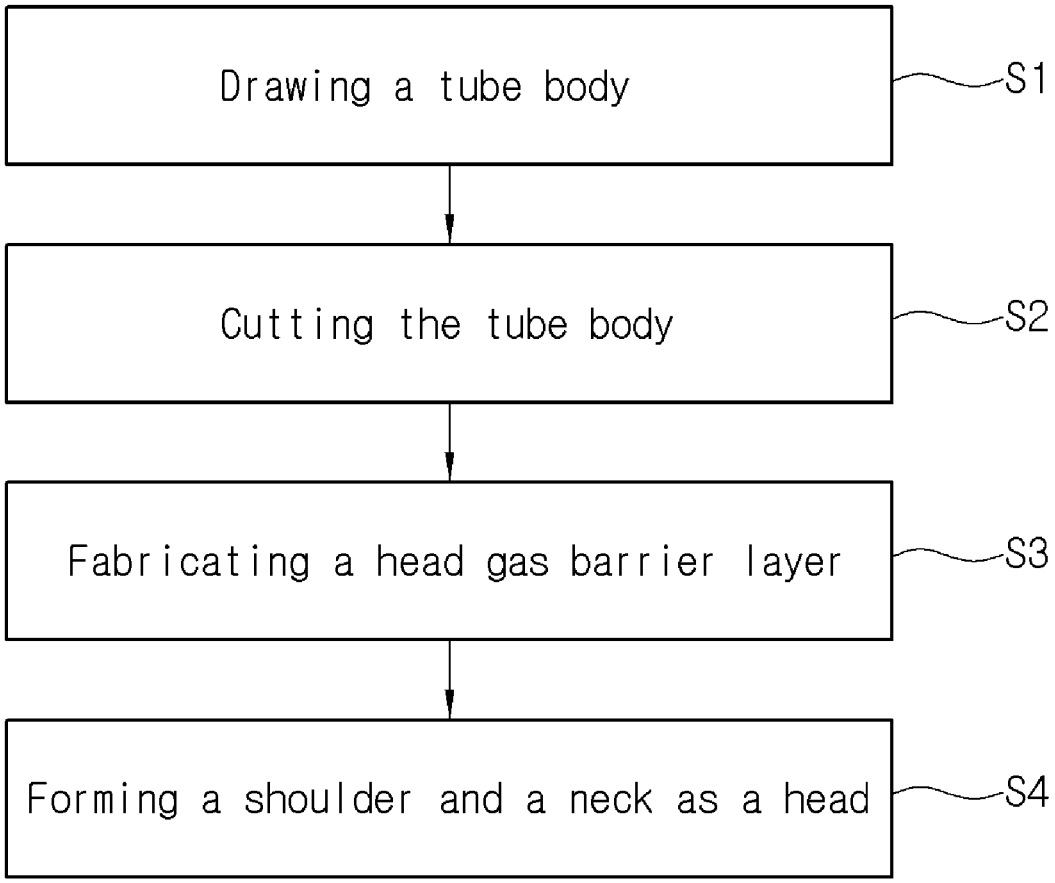
FIG. 3 is a block diagram for illustrating a method of manufacturing the present invention.

FIG. 3 is a block diagram for illustrating a method of manufacturing the present invention.

The manufacturing method will be described to achieve the above-mentioned technical configuration as shown in the drawings.

In the method of manufacturing the tube container including the gas barrier layer formed of the aluminum sheet, conventional and well-known detailed technology will be omitted.

In addition, the same reference numerals will be used for the same technical configurations with reference to FIG. 1.

First, a step S1 is performed in which a tube body 110 is manufactured to include a gas barrier layer 112 formed of an aluminum sheet.

The tube body is manufactured in a manner described in the Background and the Detailed description of the invention, and detailed descriptions will be omitted.

Next, a step S2 is performed in which the manufactured tube body 110 is cut to have a predetermined length by a well-known scheme for a required length.

In addition, a step S3 is performed in which a head gas barrier layer 10 formed of a conventional aluminum sheet is manufactured by a well-known manufacturing scheme to have a shape corresponding to a shoulder and neck portion which is a head to be formed at the front end of the cut tube body 110.

The head gas barrier layer 10 has a shape of a lamp shade to correspond to the shoulder and neck, in which a top surface positioned corresponding to the neck is manufactured to be closed.

Next, a step S4 is performed in which the shoulder 122 and the net 124 of the head 120 are formed by a well-known head forming device so that the head gas barrier layer 10 is positioned on the inner surface of the tube body after the manufactured head gas barrier layer 10 is positioned at the front end of the tube body 110 by using a general jog, pedestal or the like.

In other words, since the head is formed using a PE material or a copolymer that is a general synthetic resin having excellent adhesion, an additional adhesive is not required, and the aluminum sheet, which is the head gas barrier layer, is naturally bonded simultaneously upon the forming.

Further, a lower edge of the head gas barrier layer 10 is bonded by a junction 20 formed between an outer surface of the edge and an inner surface of the front end of the tube body 110 according to the formation of the head 120.

In other words, when a part of molten resin upon the head forming is introduced while being permeated into a space between the outer surface of the edge of the head gas barrier layer and the inner surface of the front end of the tube body, the contacting portions are tightly bonded to each other.

Accordingly, the tube body and the head gas barrier layer bonded to the inner surface of the head according to the head forming are also bonded to each other with high airtightness.

According to the present invention, the method of manufacturing the tube container includes the process for forming the head gas barrier layer in the manufacturing process by the well-known scheme.

Accordingly, only the process of interposing the head gas barrier layer is added to the process of manufacturing the tube container without a complicated process, so that the manufacturing process can be simplified without complication.

What is claimed is:

1. A tube container having a shutoff function, the tube container comprising:

a tube body;

a head disposed at a front end of the tube body and having a shoulder and a neck; and a head gas barrier layer formed of an aluminum sheet which is disposed between the tube body and the head, wherein the head gas barrier layer has a shape corresponding to a shape of an inner surface of the head, wherein a top surface of the head gas barrier layer which is located within the neck is in a closed state, wherein a bonding portion is disposed between an outer surface of an edge of a lower end of the head gas barrier layer and an inner surface of the front end of the tube body and is in contact with the outer surface of the edge of the lower end of the head gas barrier layer, and wherein the bonding portion and the head are formed of molten resin.

2. A method of manufacturing a tube container having a shutoff function, the method comprising:

manufacturing a tube body;

cutting the manufactured tube body to have a predetermined length;

manufacturing a head gas barrier layer, which is formed of an aluminum sheet, positioning the manufactured head gas barrier layer to be adjacent to a front end of the tube body; and positioning a head forming device above the head gas barrier layer and forming a head on the head gas barrier layer by the head forming device, wherein, in the forming of the head on the head gas barrier layer, a bonding portion is formed by introducing molten resin which is used for forming the head into a space between an outer surface of an edge of a lower end of the head gas barrier layer and an inner surface of the front end of the tube body, such that the bonding portion is disposed between the outer surface of the edge of the lower end of the head gas barrier layer and the inner surface of the front end of the tube body and is in contact with the outer surface of the edge of the lower end of the head gas barrier layer, wherein the head gas barrier layer has a shape corresponding to a shape of an inner surface of the head having a shoulder and a neck, and wherein a top surface of the head gas barrier layer which is located within the neck is in a closed state.

* * * * *